US012466527B1

(12) United States Patent
Matko

(10) Patent No.: US 12,466,527 B1
(45) **Date of Patent: *Nov. 11, 2025**

(54) BUOYANCY COMPENSATOR BLADDER SUITABLE FOR BOTH BACK MOUNT AND SIDE MOUNT DIVING

(71) Applicant: Szabolcs Matko, Debrecen (HU)

(72) Inventor: Szabolcs Matko, Debrecen (HU)

( * ) Notice: Subject to any disclaimer, the term of this patent is extended or adjusted under 35 U.S.C. 154(b) by 181 days.

This patent is subject to a terminal disclaimer.

(21) Appl. No.: 18/227,403

(22) Filed: Jul. 28, 2023

Related U.S. Application Data

(63) Continuation-in-part of application No. 17/583,413, filed on Jan. 25, 2022, now Pat. No. 11,738,838.

(51) Int. Cl.
*B63C 11/24* (2006.01)
*B63C 11/02* (2006.01)
*B63C 11/08* (2006.01)

(52) U.S. Cl.
CPC ..... *B63C 11/08* (2013.01)

(58) Field of Classification Search
CPC ..... B63C 11/08; B63C 2011/026; B63C 11/2245; B63C 2011/085; B63C 11/24; B63C 9/1255; B63C 11/02; B63C 11/30; B63C 11/46; B63C 2011/027; B63C 2011/303
See application file for complete search history.

(56) References Cited

U.S. PATENT DOCUMENTS 3,035,747 A * 5/1962 Ullrich, Jr. ..... B63C 11/30 224/265
3,065,888 A * 11/1962 Lande ..... B63C 11/02 224/604
3,820,348 A * 6/1974 Fast ..... B63C 11/2245 441/96
3,866,253 A * 2/1975 Sinks ..... B63C 11/2245 128/202.14
3,877,098 A * 4/1975 Braly ..... B63C 11/2245 128/202.14
4,137,585 A * 2/1979 Wright, III ..... B63C 11/2245 128/204.26
4,176,418 A * 12/1979 Scott ..... B63C 11/08 128/204.26
4,227,521 A * 10/1980 Hart ..... B63C 11/2227 128/204.26
D289,672 S * 5/1987 Pritchard ..... D24/110.5
4,681,552 A * 7/1987 Courtney ..... B63C 11/2245 441/115

(Continued)

*Primary Examiner* — Edwin J Toledo-Duran
(74) *Attorney, Agent, or Firm* — Sanchelima & Associates, P.A.; Jesus Sanchelima; Christian Sanchelima

(57) ABSTRACT

A buoyancy compensator bladder includes an air cell, a connector, a low-pressure inflator (LPI), and at least one over pressure valve. The LPI which inflates and deflates the air cell is positioned on an outer surface of the air cell. As a result, when the fully assembled buoyancy compensator is equipped by a diver, the LPI runs from behind the diver's torso and under their armpit. This results in the inflator head which is part of the LPI to be disposed on the front of the diver's chest during back mount or side mount diving. This structure allows the bladder to be easily used for either back mount or side mount diving. The bladder may further be equipped with auxiliary/non-essential devices such as wight pockets/pouches.

8 Claims, 10 Drawing Sheets

(56) References Cited

U.S. PATENT DOCUMENTS 4,690,314 A * 9/1987 Faulconer ..... B63C 11/08 224/628
4,720,281 A * 1/1988 Matsuoka ..... B63C 11/08 441/108
4,752,263 A * 6/1988 Pritchard ..... B63C 11/02 128/202.14
4,778,307 A * 10/1988 Faulconer ..... B63C 11/08 441/106
4,779,554 A * 10/1988 Courtney ..... B63C 9/1255 441/116
4,810,134 A * 3/1989 Eaulconer ..... B63C 11/08 441/118
5,249,890 A * 10/1993 Bergstrom ..... B63C 11/02 405/185
5,346,419 A * 9/1994 Kaiser ..... B63C 11/08 441/96
5,378,084 A * 1/1995 Walters ..... B63C 11/08 441/106
5,403,123 A * 4/1995 Walters ..... B32B 5/024 405/186
5,516,233 A * 5/1996 Courtney ..... B63C 11/02 441/106
5,522,679 A * 6/1996 Eungard ..... B63C 11/08 441/108
5,607,258 A * 3/1997 Eungard ..... B63C 11/2245 441/106
5,620,282 A * 4/1997 Stinton ..... B63C 11/08 441/106
5,662,433 A * 9/1997 Seligman ..... A41D 13/0125 441/106
5,855,454 A * 1/1999 Courtney ..... B63C 9/155 441/108
6,039,043 A * 3/2000 Graber ..... B63C 11/2245 128/206.28
6,477,709 B1 * 11/2002 Kawana ..... B63C 11/08 2/2.15
6,503,114 B2 * 1/2003 Kawashima ..... B63C 11/08 441/116
6,666,622 B1 * 12/2003 Courtney ..... B63C 11/30 441/115
8,834,069 B1 * 9/2014 Harvey ..... B63C 11/08 137/505.46
2001/0036781 A1 * 11/2001 Cressi ..... B63C 11/08 441/88

* cited by examiner

BUOYANCY COMPENSATOR BLADDER SUITABLE FOR BOTH BACK MOUNT AND SIDE MOUNT DIVING

OTHER RELATED APPLICATIONS

The present application is a continuation-in-part of allowed U.S. patent application Ser. No. 17/583,413, filed on Jan. 25, 2022, which is hereby incorporated by reference.

BACKGROUND OF THE INVENTION

Field of the Invention

The present invention relates to a buoyancy compensator bladder and, more particularly, to a buoyancy compensator bladder that includes a low-pressure inflator suitably positioned for both back mount and side mount diving.

Description of the Related Art

Several designs for a buoyancy compensator bladder have been designed in the past. None of them, however, include a buoyancy compensator bladder with a low-pressure inflator (LPI) suitably positioned for both back mount and side mount diving configurations. The LPI which inflates and deflates the air cell is positioned on an outer surface of the air cell. As a result, when the fully assembled buoyancy compensator is equipped by a diver, the LPI runs from behind the diver's torso and under their armpit. This results in the inflator head which is part of the LPI to be disposed on the front of the diver's chest during back mount or side mount diving. This structure allows the bladder to be easily used for either back mount or side mount diving. It is known that divers often use back mount or side mount configurations when diving. Additionally, most buoyancy compensator bladders are currently designed to work exclusively for either back mount or side mount diving. Therefore, there is a need for a buoyancy compensator bladder that allows for the LPI to run under the diver's armpit for use of both back mount and side mount diving. This allows the present invention to adapt to a user's preferred method of diving.

Applicant believes that a related reference corresponds to U.S. Pat. No. 3,877,098 issued for a buoyancy pillow for a free diver that is attached to the ventral side of diver's trunk by shoulder, waist, and crotch straps. Applicant believes that another related reference corresponds to U.S. Pat. No. 5,662,433 issued for a combination spider and buoyancy compensator having a chest portion which include stretchable material to support the breasts of a diver. However, the cited references differ from the present invention because they fail to disclose a buoyancy compensator bladder with an LPI suitably positioned to run under the diver's armpit to allow for both back mount and side mount diving. The location of the LPI mounted provides a flexible configuration that adapts to a user's need based on preference when performing a diving task.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a buoyancy compensator bladder with an LPI that runs under diver's armpit when the bladder is used for back mount diving.

It is another object of the present invention to provide a buoyancy compensator bladder with an LPI that runs under the diver's armpit when the bladder is used for side mount diving.

It is another object of this invention to provide a buoyancy compensator bladder that does not need to be repositioned. Additionally, neither the bladder nor the buoyancy compensator has to be reconfigured when switching from back mount to side mount diving.

It is still another object of the present invention to provide a buoyancy compensator bladder that is versatile and easy to use.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
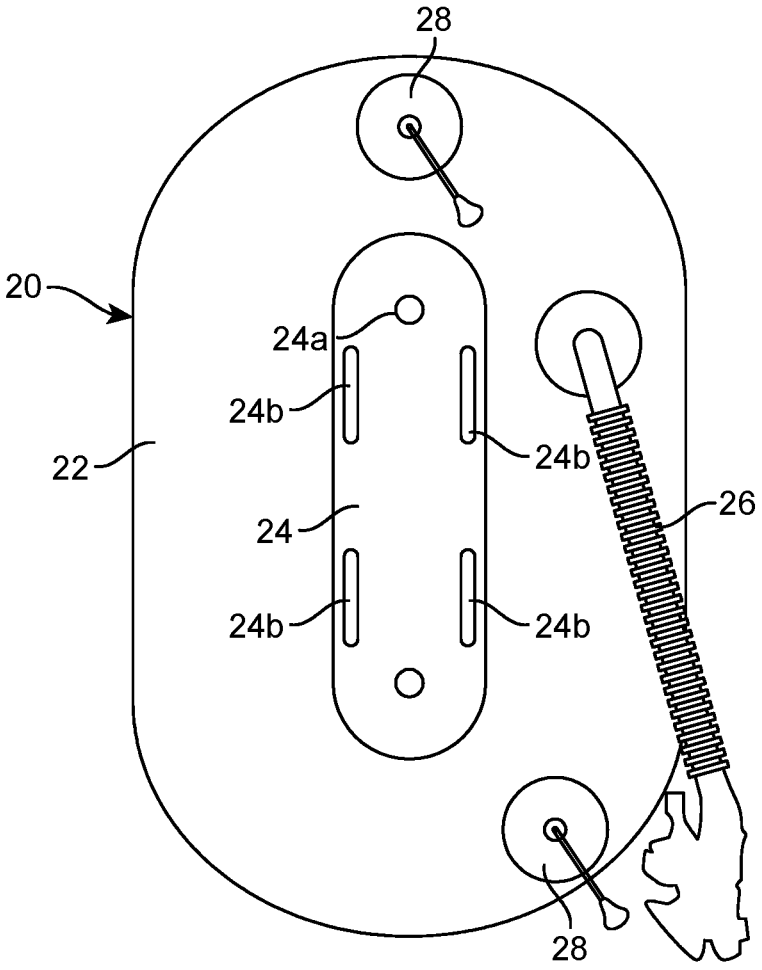
FIG. 1 represents a front view of bladder assembly 20 in accordance with an embodiment of the present invention.

Referring now to the drawings, where the present invention is generally referred to with numeral 10, it can be observed a buoyancy compensator system 10 which basically includes a bladder assembly 20, a backplate assembly 40, and a cylinder adapter assembly 60.

Bladder assembly 20 includes an air cell 22. In one embodiment, air cell 22 has a substantially oval shape and includes a front side and a rear side. Air cell 22 is to be provided as a suitable air cell that is used in diving environments. Bladder assembly 20 further includes a connector 24 disposed along the center portion of air cell 22. In the present implementation, connector 24 is operatively connected to backplate assembly 40 and cylinder adapter assembly 60. Connector 24 may have an oval shape and may be secured to air cell 22 by means of stitches along the entire perimeter of connector 24. Connector 24 may include first connector holes 24*a* and second connector holes 24*b*. It should be understood that air cell 22 and connector 24 may have any other suitable shape different from the present embodiment. The first connector holes 24*a* may preferably be a first circular hole disposed on a top portion of the connector 24 and a second circular hole disposed on a bottom portion of the connector 24. The second connector holes 24*b* may have an elongated shape. The second connector holes 24*b* may preferably be four holes equidistantly disposed on the connector 24.

Figure 5:
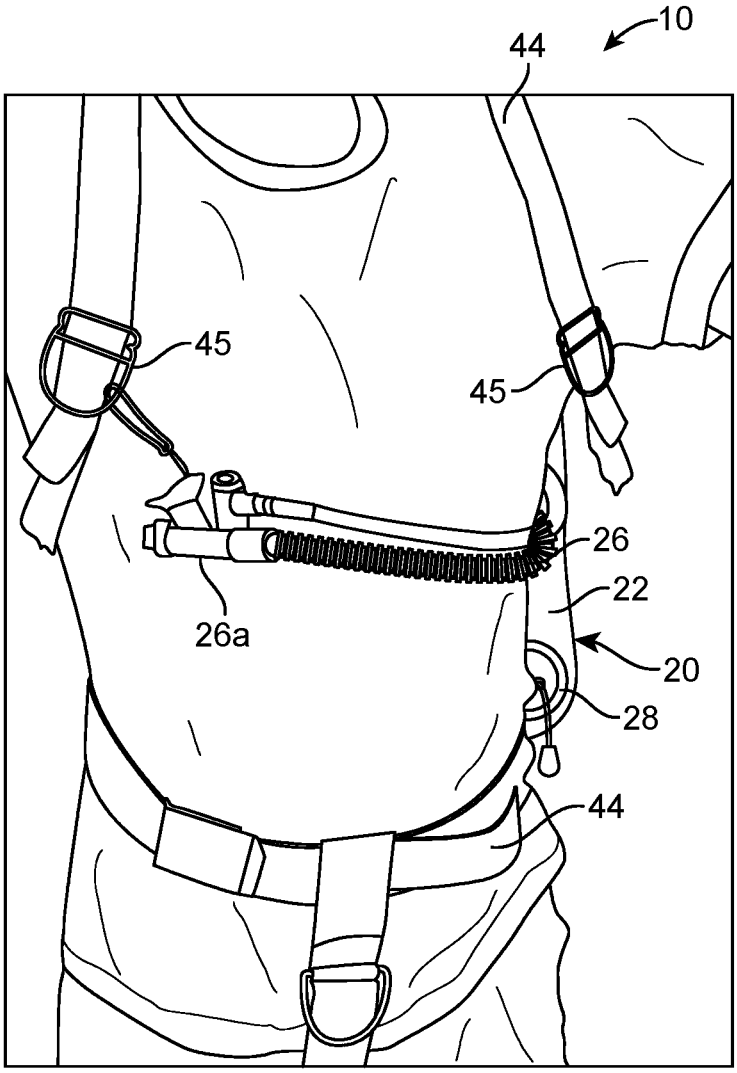
FIG. 5 shows a front view of buoyancy compensator system 10 mounted to a user in accordance with an embodiment of the present invention.
Figure 8:
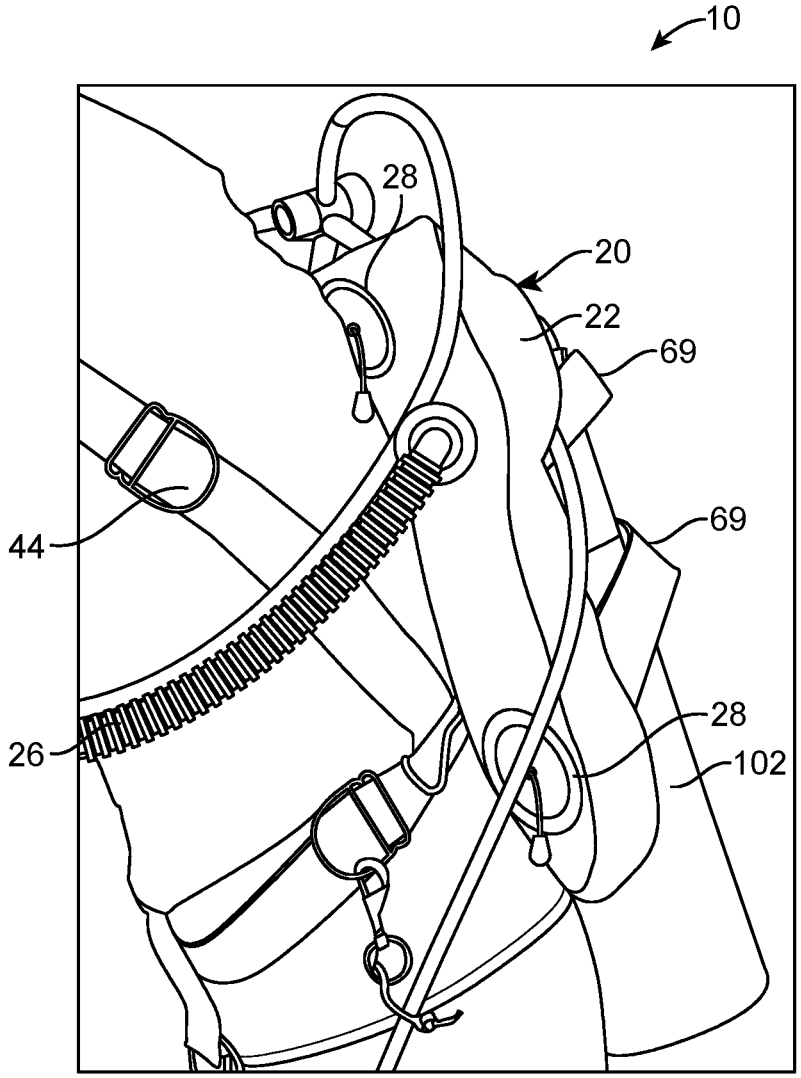
FIG. 8 shows an isometric side view of buoyancy compensator system 10 assembled in a rear mount configuration and mounted to a user in accordance with an embodiment of the present invention.
Figure 11:
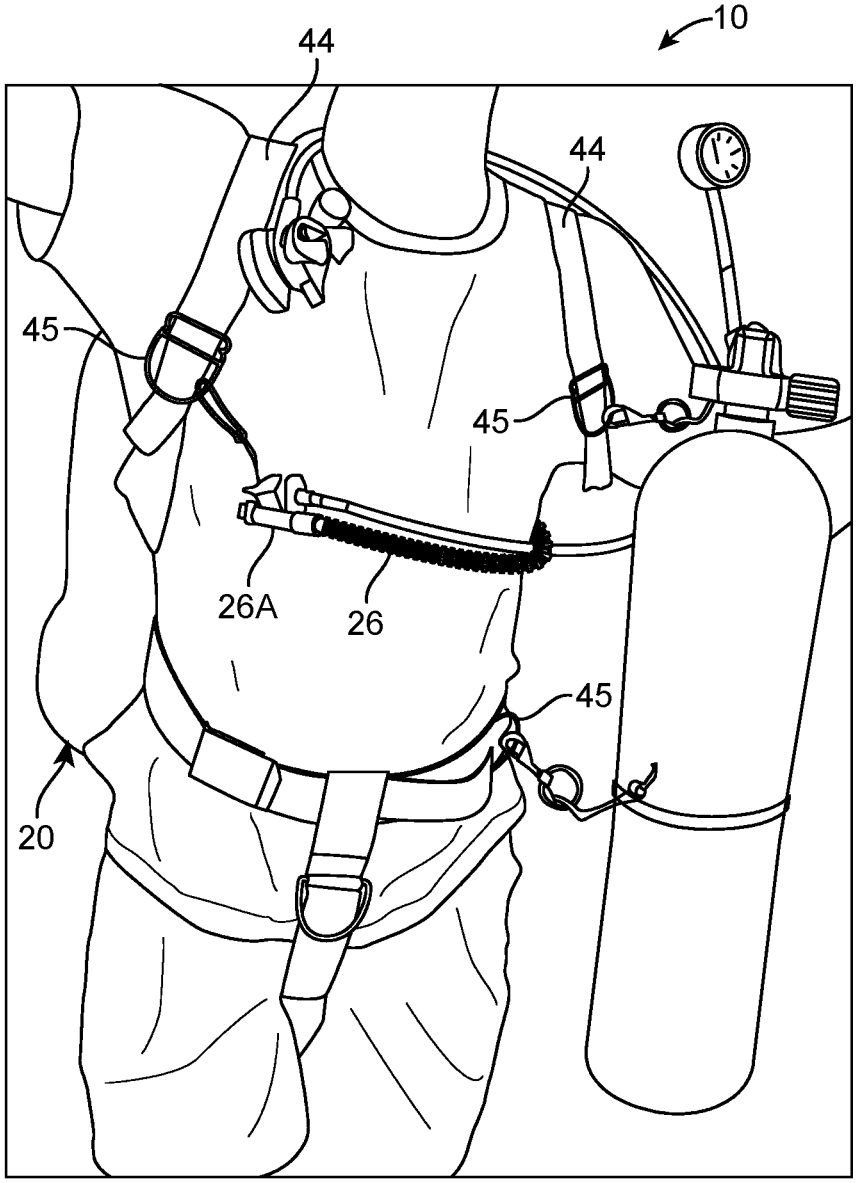
FIG. 11 shows an isometric side view of buoyancy compensator system 10 assembled in a side mount configuration and mounted to a user in accordance with an embodiment of the present invention.

Bladder assembly 20 further includes a low-pressure inflator (LPI) 26 secured on the exterior surface of the air cell. The location of LPI 26 is pertinent to the configuration of the present invention. Air cell 22 includes a top surface portion, a bottom surface portion, and a middle surface portion. In the present embodiment, LPI 26 is positioned along the middle surface portion of air cell 22 as observed in FIG. 1. The location of the LPI 26 allows for the present system to utilize both side mount and rear mount diving configurations. The positioning of LPI 26 allows for it to run underneath a user's armpit as observed in FIG. 5. FIGS. 8 and 11 depict a rear mount configuration and side mount configuration respectively. It can be observed that the present configuration allows for LPI 26 to run underneath the user's armpit regardless of which type of diving configuration is being utilized. In both configurations, the inflator head 26A can be attached to the harness' 44 shoulder D-ring 45 by means of a piece of bungee rope and a carabiner. As a result, the diver can easily reach to the inflator head 26A and operate it with either the left or right hand of a user.

Bladder assembly 20 further includes overpressure valve 28 disposed on the air cell 22. In the present embodiment depicted in FIG. 1, air cell 22 contains two overpressure valves 28. However, it should be understood that the present invention could be configured with at least one overpressure valve 28.

Backplate assembly 40 includes a backplate 42 and harness 44. Backplate 42 may be provided as a metal backplate that is coupled to air cell 22. Backplate 42 includes first backplate holes 42*a* and second backplate holes 42*b*. The first backplate holes 42*a* may preferably be a first circular backplate hole disposed on a top portion of the backplate 42 and a second circular backplate hole disposed on a bottom portion of the backplate. The second backplate holes 42*b* may have an elongated shape. The second backplate holes 42*b* may preferably be four holes equidistantly disposed on the backplate 42. The second backplate holes 42*b* may align with the second connector holes 24*b*. The first backplate holes 42*a* may align with a position and shape of the first connector holes 24*a*. Backplate 42 allows for air cell 22 to be engaged with a user's back. It should be understood that backplate 42 should have a size and shape that cooperates with the size and shape of connector 24 and cylinder adapter assembly 60. Furthermore, harness 44 includes a plurality of D-rings 45. Other additional structural elements may be implemented into the backplate assembly 40 such as a crotch strap and other common diving elements.

Figure 2:
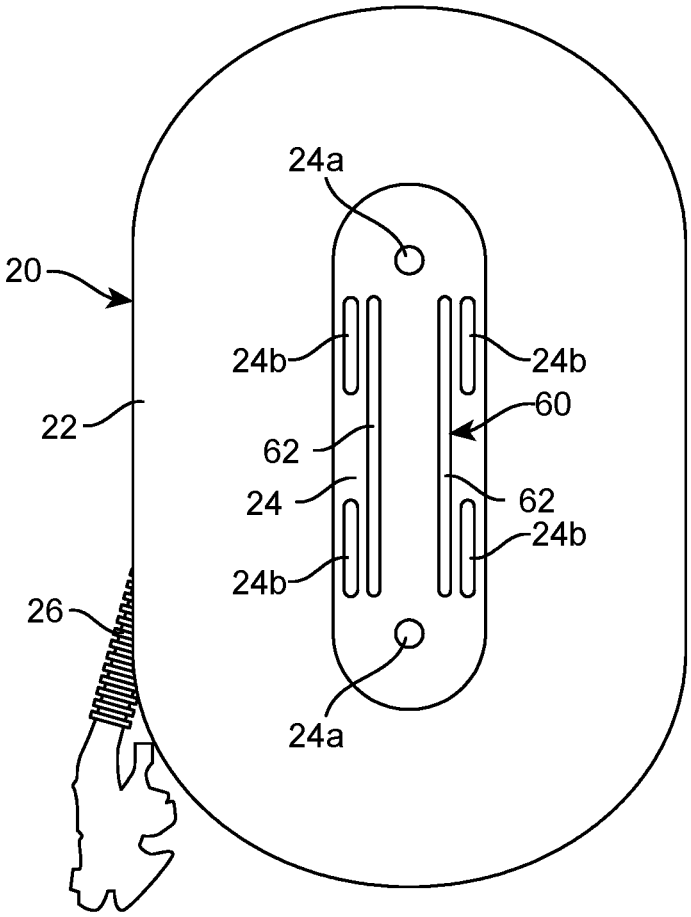
FIG. 2 shows a rear view of bladder assembly 20 in accordance with an embodiment of the present invention.
Figure 3:
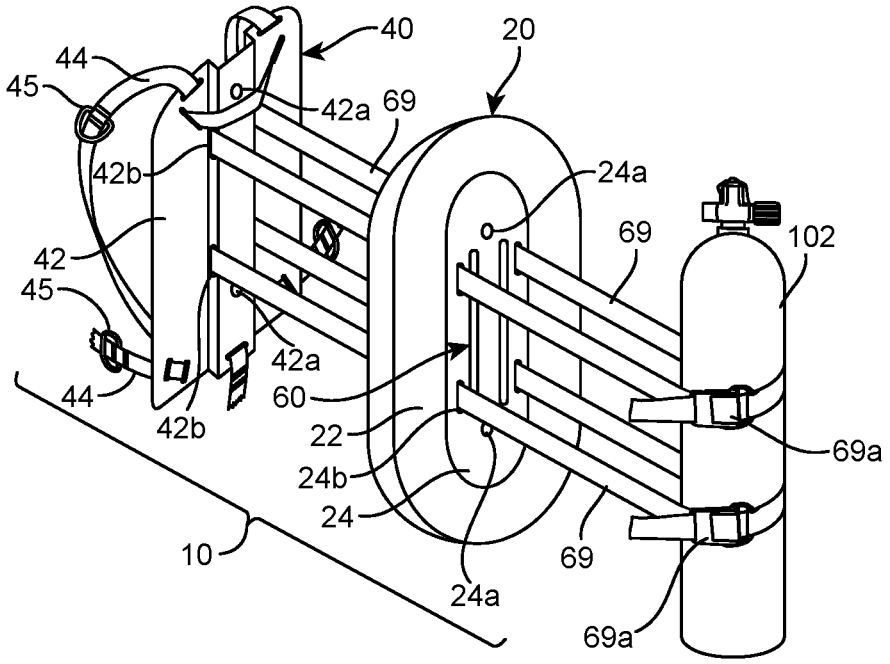
FIG. 3 illustrates an isometric exploded view of buoyancy compensator system 10 depicting bladder assembly 20, backplate assembly 40, and cylinder adapter assembly 60 in accordance with an embodiment of the present invention 10.
Figure 4:
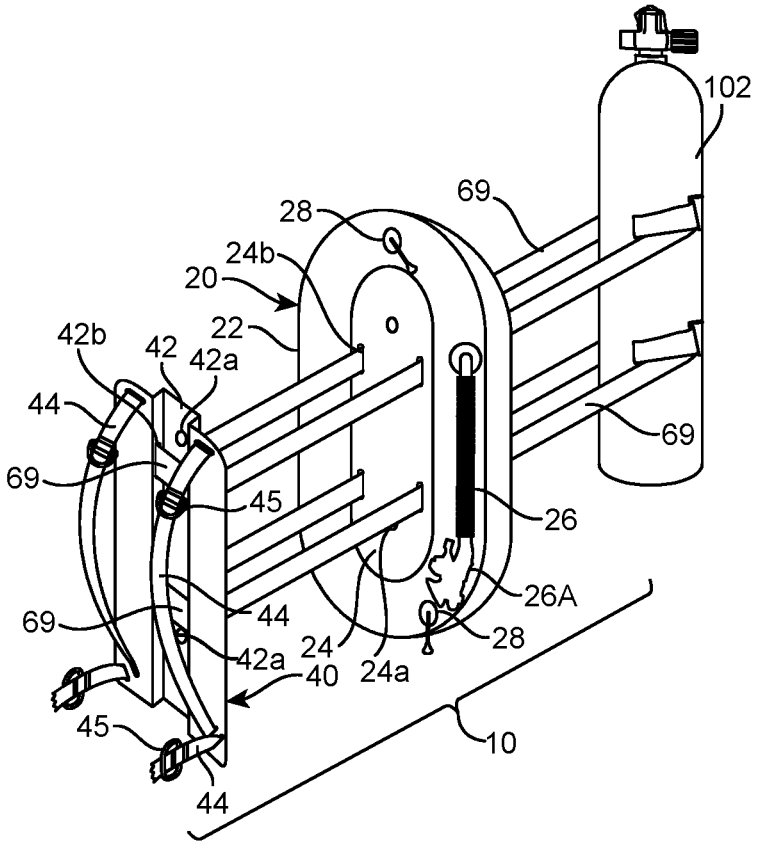
FIG. 4 is a representation of another isometric exploded view of buoyancy compensator system 10 depicting bladder assembly 20, backplate assembly 40, and cylinder adapter assembly 60 in accordance with an embodiment of the present invention.

Cylinder adapter assembly 60 includes adapter members 62 that is are coupled to air cell 22 as observed in FIGS. 2 and 3 of the drawings. The adapter members 62 may be two vertical bars mounted to the rear end of the connector 24 by means of stitching, gluing, or the like. It also may be suitable to have the adapter members 62 mounted to both connector 24 and backplate 42 by means of bolts, nuts, screws, or the like. The adapter members may have a rectangular shape with rounded corners extending a length of the connector 24. The adapter members 62 may be separated a predetermined distance and parallel therebetween. The adapter members 62 may be made of plastic, metal, or any other suitable material. A diving cylinder is placed between the adapter members 62. The adapter members 62 prevent movement of the diving cylinder 102 when placed therebetween. Cylinder adapter assembly 60 may further include fastening members 66 and cam bands 69. As it will be pointed out below, in some embodiments only the cam bands 69, only the fastening members 66 or a combination thereof are used. As a result, all the assemblies are engaged when the present invention 10 is assembled.

Figure 7:
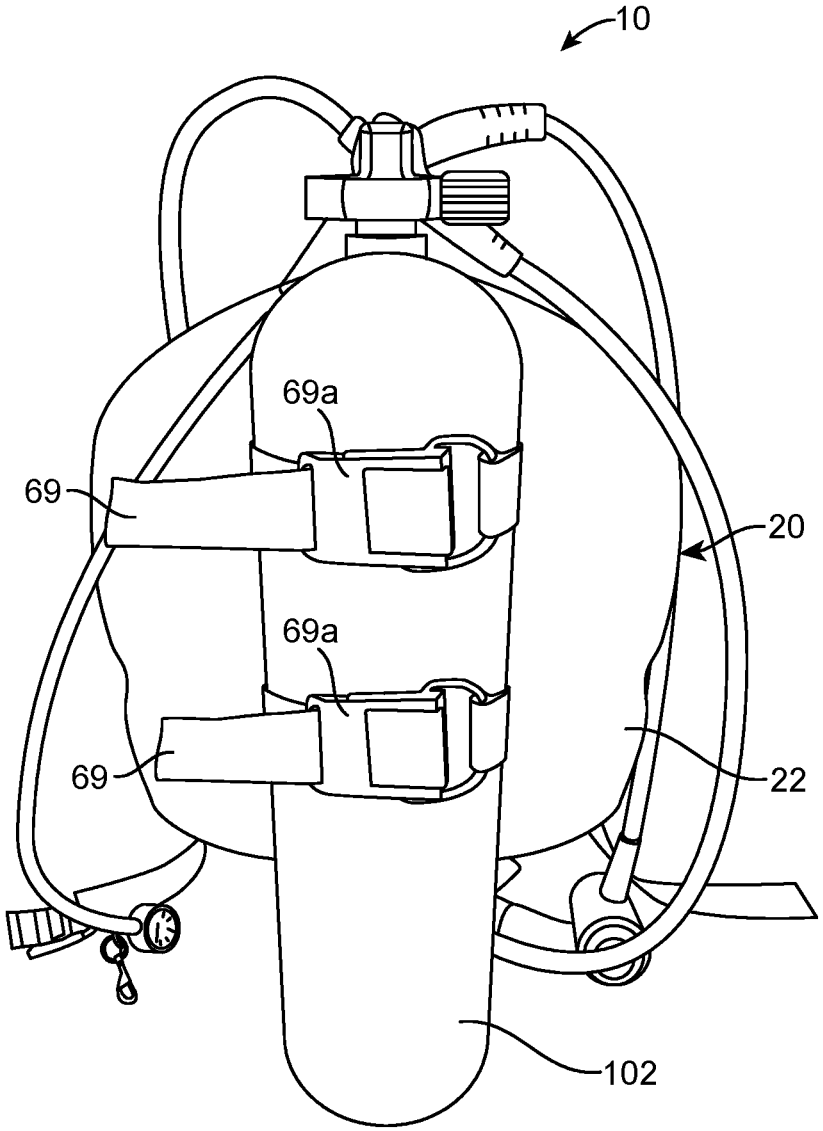
FIG. 7 represents a rear view of buoyancy compensator system 10 assembled in a rear mount configuration in accordance with an embodiment of the present invention.

FIG. 7 depicts a diving cylinder 102 securely mounted to the adapter members 62 by means of the cam bands 69. Cam bands 69 are utilized to secure the cylinder to the bladder assembly 20 as depicted in the drawing. The cam bands 69 may surround the diving cylinder 102. The cam bands 69 may include cam band buckles 69*a*. The cam band buckles 69*a* may be operated to adjust the length of the cam bands 69 to secure the air cell 22, the backplate 42, the diving cylinder 102, or any combination thereof, together.

Figure 6:
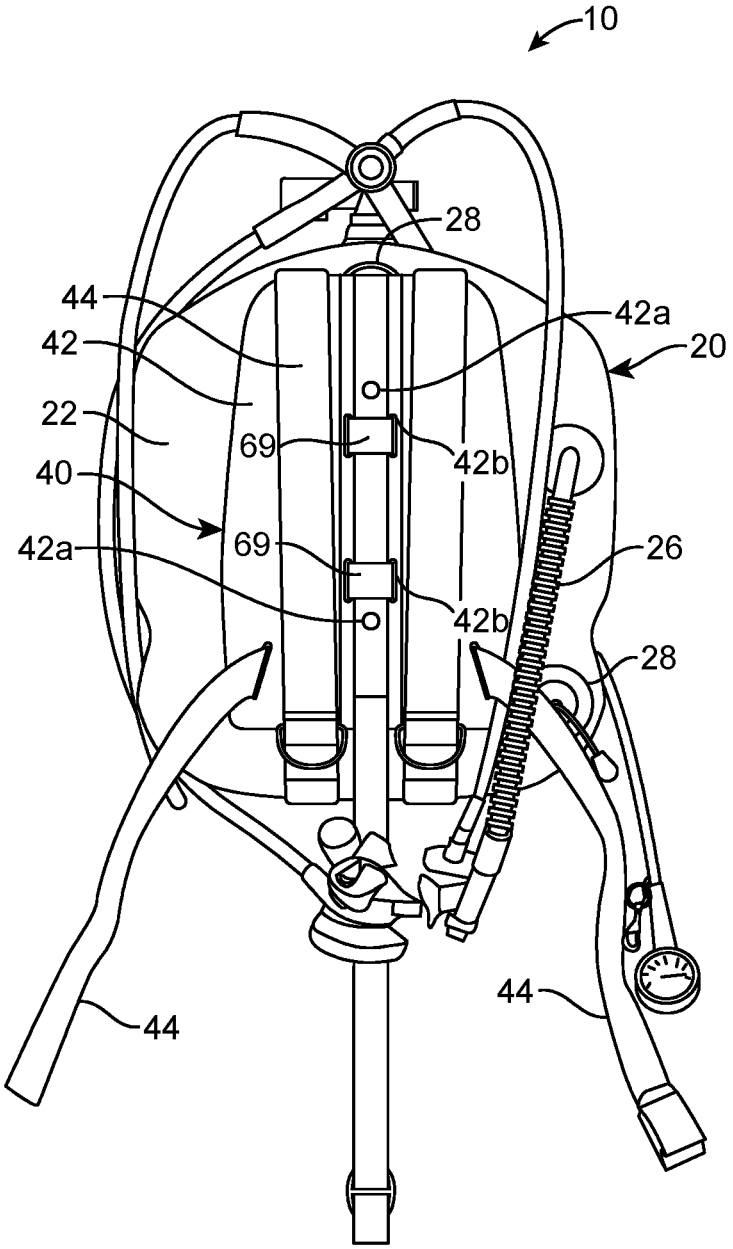
FIG. 6 illustrates a front view of buoyancy compensator system 10 assembled in a rear mount configuration in accordance with an embodiment of the present invention.
Figure 9:
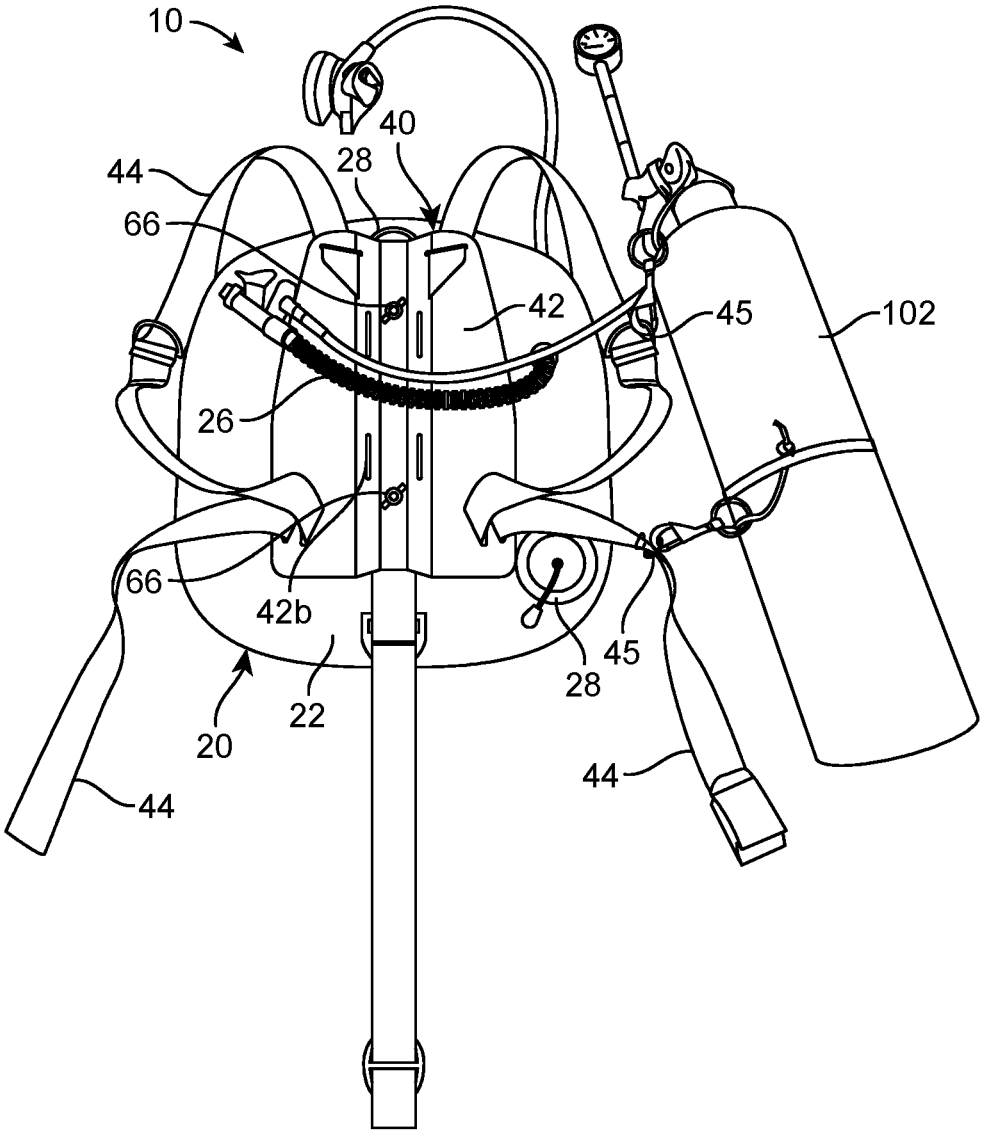
FIG. 9 illustrates a front view of buoyancy compensator system 10 assembled in a side mount configuration in accordance with an embodiment of the present invention.
Figure 10:
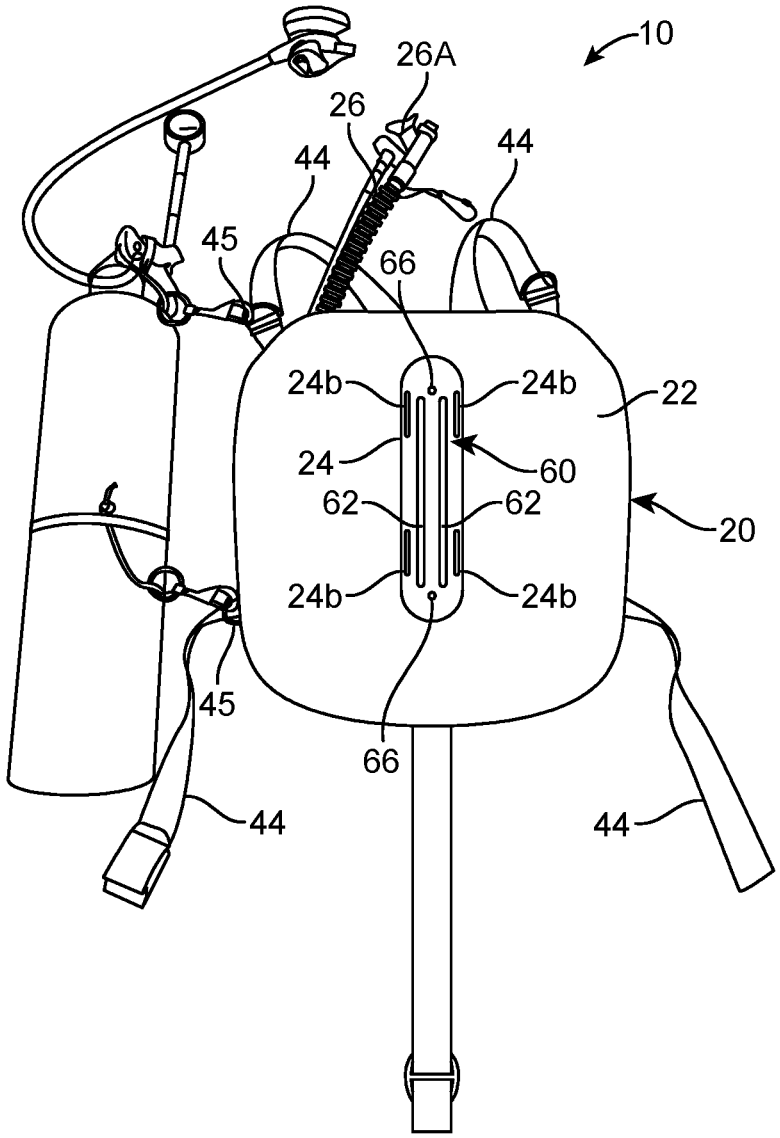
FIG. 10 is a representation of a rear view of buoyancy compensator system 10 assembled in a side mount configuration in accordance with an embodiment of the present invention.

FIGS. 6-8 depict the present system engaged in the rear mount configuration. Cam bands 69 engage with air cell 22 and backplate 42 via second connector holes 24*b* and second backplate holes 42*b* to secure the backplate 42, air cell 22, and diving cylinder 102 together. The backplate 42 may have a rectangular channel extending about a length thereof. The cam bands 69 may go through the second backplate holes 42*b* and horizontally across the channel of the backplate 42. The LPI 26 comfortably runs under the armpit of the user and the inflator head 26A comfortably sits at the front end of the user. FIGS. 9-11 depict the present system engaged in a side mount configuration. Alternatively, or in a combination thereof, the fastening members 66 may engage with air cell 22, and backplate 42 via first backplate holes 42*a*, and first connector holes 24*a* to secure the backplate 42 and the air cell 22 together. Alternatively to the fastening members 66, Velcro straps may be used which would secure together the air cell 22 and backplate 42 via second connector holes 24*b* and second backplate holes 42*b* (not shown in the drawings). It can be observed that the cylinder is connected to two D-rings 45 located on the harness 44 with one D-ring 45 on the shoulder strap, and another D-ring 45 on the waist strap by means of two swivel rings with a single end bolt snap. The figures depict one cylinder mounted onto the system. However, it should be understood that two cylinders may be utilized for the side mount configuration. The LPI 26 then comfortably runs under the armpit of the user and the inflator head 26A sits at the front end of the user similarly to the configuration of the rear mount diving. The present invention advantageously allows for a diver to use their preferred diving configuration without the need to change equipment to suit rear mount or side mount diving.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A buoyancy compensator system, comprising:

a) a bladder assembly including an air cell, wherein said air cell has an oval shape, wherein the air cell includes a first over pressure valve and a second over pressure valve, a connector and a low-pressure inflator mounted along a middle surface portion of said air cell, wherein said air cell includes a top surface portion and a bottom surface portion, wherein the low-pressure inflator is adapted to be positioned underneath an armpit of a user, wherein said connector is disposed on the middle surface portion of said air cell having a predetermined separation with edges of said air cell, wherein said connector includes first connector holes and second connector holes, wherein said first over pressure valve is located on said top surface portion and said second over pressure valve is located on said bottom surface portion;

b) a cylinder adapter assembly receiving a cylinder to be coupled thereon, wherein said cylinder adapter assembly includes adapter members, wherein said adapter members have a rectangular elongated shape, wherein said adapter members are capable of be used to receive said cylinder, wherein said adapter members are attached to a rear end of said connector; and c) a backplate assembly, wherein said backplate assembly includes a backplate being coupled with the connector of the air cell at a front face thereof, wherein said backplate has a rectangular shape with top rounded corners and a central channel disposed at a central portion thereof, wherein said central channel extends a length of said backplate, said central channel having a rear wall and sidewalls, wherein said rear wall of said channel includes first backplate holes and said sidewalls include second backplate holes, wherein said backplate includes harness, wherein said harness are configured to secure said backplate to the user, wherein said harness include a first set of harness and a second set of harness, wherein said first set of harness extend vertically from a top portion of said backplate to a bottom portion of said backplate, wherein said second set of harness extend horizontally from a right-bottom portion of said backplate to a left-bottom portion of said backplate, wherein said harness include a plurality of D-rings therein, wherein cam bands are introduced through said second connector holes and said second backplate holes and surrounding said cylinder to secure said cylinder to said air cell and said air cell to said backplate.

2. The buoyancy compensator system set forth in claim 1, wherein said second connector holes are four rectangular connector holes equidistantly formed in said connector.

3. The buoyancy compensator system set forth in claim 2, wherein said second backplate holes conform with a shape of said second connector holes, wherein said second backplate holes align with said second connector holes when connected together by means of said cam bands.

4. The buoyancy compensator system set forth in claim 1, wherein said backplate assembly includes fastening members, wherein said fastening members are introduced through said first backplate holes and said first connector holes to attach together said air cell with said backplate.

5. The buoyancy compensator system set forth in claim 1, wherein the low-pressure inflator further includes an inflator head.

6. The buoyancy compensator system set forth in claim 1, wherein said cam bands include cam band buckles, said cam band buckles are operated to adjust a length of said cam bands.

7. A buoyancy compensator system, comprising:

a) a bladder assembly including an air cell, wherein said air cell has an oval shape, wherein the air cell includes a first over pressure valve and a second over pressure valve, a connector and a low-pressure inflator mounted along a middle surface portion of said air cell, wherein said air cell includes a top surface portion and a bottom surface portion, wherein the low-pressure inflator is adapted to be positioned underneath an armpit of a user, wherein said connector is disposed on the middle surface portion of said air cell having a predetermined separation with edges of said air cell, wherein said connector includes first connector holes and second connector holes, wherein said first over pressure valve is located on said top surface portion and said second over pressure valve is located on said bottom surface portion;

b) a cylinder adapter assembly receiving a cylinder to be coupled thereon, wherein said cylinder adapter assembly includes adapter members, wherein said adapter members have a rectangular elongated shape, wherein said adapter members are capable of be used to receive said cylinder, wherein said adapter members are attached to a rear end of said connector; and c) a backplate assembly, wherein said backplate assembly includes a backplate being coupled with the connector of the air cell at a front face thereof and fastening members, wherein said backplate has a rectangular shape with top rounded corners and a central channel disposed at a central portion thereof, wherein said central channel extends a length of said backplate, said central channel having a rear wall and sidewalls, wherein said rear wall of said channel includes first backplate holes and said sidewalls include second backplate holes, wherein said fastening members are introduced through said first backplate holes and said first connector holes to attach together said air cell with said backplate, wherein said backplate includes harness, wherein said harness are configured to secure said backplate to the user, wherein said harness include a first set of harness and a second set of harness, wherein said first set of harness extend vertically from a top portion of said backplate to a bottom portion of said backplate, wherein said second set of harness extend horizontally from a right-bottom portion of said backplate to a left-bottom portion of said backplate, wherein said harness include a plurality of D-rings therein, wherein cam bands are introduced through said second connector holes and said second backplate holes and surrounding said cylinder to secure said cylinder to said air cell and said air cell to said backplate, wherein said second connector holes are four rectangular connector holes equidistantly formed in said connector, wherein said second backplate holes conform with a shape of said second connector holes, wherein said second backplate holes align with said second connector holes when connected together by means of said cam bands.

8. A buoyancy compensator system, consisting of:

a) a bladder assembly including an air cell, wherein said air cell has an oval shape, wherein the air cell includes a first over pressure valve and a second over pressure valve, a connector and a low-pressure inflator mounted along a middle surface portion of said air cell, wherein said air cell includes a top surface portion and a bottom surface portion, wherein the low-pressure inflator is adapted to be positioned underneath an armpit of a user, wherein the low-pressure inflator further includes an inflator head, wherein said connector is disposed on the middle surface portion of said air cell having a predetermined separation with edges of said air cell, wherein said connector includes first connector holes and second connector holes, wherein said first over pressure valve is located on said top surface portion and said second over pressure valve is located on said bottom surface portion, wherein said first connector holes have a circular shape;

b) a cylinder adapter assembly receiving a cylinder to be coupled thereon, wherein said cylinder adapter assembly includes adapter members, wherein said adapter members have a rectangular elongated shape, wherein said adapter members are capable of be used to receive said cylinder, wherein said adapter members are attached to a rear end of said connector, wherein said adapter members include two adapter members spaced and parallel therebetween, said adapter members are vertically disposed; and c) a backplate assembly, wherein said backplate assembly includes a backplate being coupled with the connector of the air cell at a front face thereof and fastening members, wherein said backplate has a rectangular shape with top rounded corners and a central channel disposed at a central portion thereof, wherein said central channel extends a length of said backplate, said central channel having a rear wall and sidewalls, wherein said rear wall of said channel includes first backplate holes and said sidewalls include second backplate holes, wherein said fastening members are introduced through said first backplate holes and said first connector holes to attach together said air cell with said backplate, wherein said backplate includes harness, wherein said harness are configured to secure said backplate to the user, wherein said harness include a first set of harness and a second set of harness, wherein said first set of harness extend vertically from a top portion of said backplate to a bottom portion of said backplate, wherein said second set of harness extend horizontally from a right-bottom portion of said backplate to a left-bottom portion of said backplate, wherein said harness include a plurality of D-rings therein, wherein cam bands are introduced through said second connector holes and said second backplate holes and surrounding said cylinder to secure said cylinder to said air cell and said air cell to said backplate, wherein said cam bands include cam band buckles, said cam band buckles are operated to adjust a length of said cam bands, wherein said second connector holes are four rectangular connector holes equidistantly formed in said connector, wherein said second backplate holes conform with a shape of said second connector holes, wherein said second backplate holes align with said second connector holes when connected together by means of said cam bands.

* * * * *